US006584619B1

(12) United States Patent
Macri

(10) Patent No.: US 6,584,619 B1
(45) Date of Patent: Jul. 1, 2003

(54) PROTECTIVE BODY GARMENT

(76) Inventor: Frank Macri, 114 Clearview Drive, Port Moody, BC (CA), V3H 2S8

( * ) Notice: Subject to any disclaimer, the term of this patent is extended or adjusted under 35 U.S.C. 154(b) by 118 days.

(21) Appl. No.: 10/034,675

(22) Filed: Dec. 28, 2001

(51) Int. Cl.[7] ..... A41D 13/12

(52) U.S. Cl. ..... 2/456; 2/93; 2/455; 2/464; 2/467

(58) Field of Search ..... 2/456, 69, 69.5, 2/267, 455, 16, 22, 24, 94, 93, 108, 85, 97, 102, 459, 460, 461, 462, 463, 464, 465, 466, 467

(56) References Cited

U.S. PATENT DOCUMENTS 3,134,106 A 5/1964 Shaffer et al.
3,991,420 A 11/1976 Savarino
4,507,801 A 4/1985 Kavanagh et al.
4,590,622 A 5/1986 Wolfe et al.
D293,495 S 12/1987 Berryman et al.
5,325,537 A 7/1994 Marion
6,148,447 A * 11/2000 Bain et al. ..... 2/456
6,295,654 B1 * 10/2001 Farrell ..... 2/456

* cited by examiner

*Primary Examiner*—Gary L. Welch

(57) ABSTRACT

A protective body garment including a body covering for protecting the body from injury during sporting events and having a plurality of pads, a torso portion having a neck opening therein and two sleeve portions fixedly coupled thereto. Each of the pads is covered by a panel made from cloth and sewn to the garment. A plurality of cushions is fixedly coupled to the garment and is covered by a panel, which is sewn to the garment. Each of the cushions has a base portion and a hollow collapsible member directed away from the garment wherein the collapsible member is fixedly coupled to the base portion. A first cushion is fixedly coupled to a right elbow portion of the garment and a second cushion is fixedly coupled to a left elbow portion of the garment.

10 Claims, 2 Drawing Sheets

PROTECTIVE BODY GARMENT

BACKGROUND OF THE INVENTION

1. Field of the Invention

The present invention relates to body padding and more particularly pertains to a new protective body garment for protecting the body from injury during sporting events.

2. Description of the Prior Art

The use of body padding is known in the prior art. More specifically, body padding heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,507,801; U.S. Pat. No. 5,325,537; U.S. Pat. No. 4,590,622; U.S. Pat. No. 293,495; U.S. Pat. No. 3,134,106; and U.S. Pat. No. 3,991,420.

While these devices fulfill their respective, particular objectives and requirements, the aforementioned patents do not disclose a new protective body garment. The inventive device includes a body covering. The body covering includes a torso portion and two sleeve portions fixedly coupled thereto. The torso portion has a neck opening therein. A plurality of pads is each fixedly coupled to the body covering. Each of the pads is covered by a panel sewn to the garment. Each of the panels are made from cloth. The pads generally cover the garment. A plurality of cushions is each fixedly coupled to the garment. Each of the cushions is covered by a panel, which is sewn to the garment. Each of the cushions has a base portion and a collapsible member. The collapsible member is fixedly coupled the base portion. The collapsible member is generally hollow. The collapsible member is directed away from the garment. A first cushion is fixedly coupled to a right elbow portion of the garment. A second cushion is fixedly coupled to a left elbow portion of the garment.

In these respects, the protective body garment according to the present invention substantially departs from the conventional concepts and designs of the prior art, and in so doing provides an apparatus primarily developed for the purpose of protecting the body from injury during sporting events.

SUMMARY OF THE INVENTION

In view of the foregoing disadvantages inherent in the known types of body padding now present in the prior art, the present invention provides a new protective body garment construction wherein the same can be utilized for protecting the body from injury during sporting events.

The general purpose of the present invention, which will be described subsequently in greater detail, is to provide a new protective body garment apparatus and method which has many of the advantages of the body padding mentioned heretofore and many novel features that result in a new protective body garment which is not anticipated, rendered obvious, suggested, or even implied by any of the prior art body padding, either alone or in any combination thereof.

To attain this, the present invention generally comprises a body covering. The body covering includes a torso portion and two sleeve portions fixedly coupled thereto. The torso portion has a neck opening therein. A plurality of pads is each fixedly coupled to the body covering. Each of the pads is covered by a panel sewn to the garment. Each of the panels are made from cloth. The pads generally cover the garment. A plurality of cushions is each fixedly coupled to the garment. Each of the cushions is covered by a panel, which is sewn to the garment. Each of the cushions has a base portion and a collapsible member. The collapsible member is fixedly coupled the base portion. The collapsible member is generally hollow. The collapsible member is directed away from the garment. A first cushion is fixedly coupled to a right elbow portion of the garment. A second cushion is fixedly coupled to a left elbow portion of the garment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective body garment apparatus and method which has many of the advantages of the body padding mentioned heretofore and many novel features that result in a new protective body garment which is not anticipated, rendered obvious, suggested, or even implied by any of the prior art body padding, either alone or in any combination thereof.

It is another object of the present invention to provide a new protective body garment which may be easily and efficiently manufactured and marketed.

It is a further object of the present invention to provide a new protective body garment which is of a durable and reliable construction.

An even further object of the present invention is to provide a new protective body garment which is susceptible of a low cost of manufacture with regard to both materials and labor, and which accordingly is then susceptible of low prices of sale to the consuming public, thereby making such protective body garment economically available to the buying public.

Still yet another object of the present invention is to provide a new protective body garment which provides in the apparatuses and methods of the prior art some of the advantages thereof, while simultaneously overcoming some of the disadvantages normally associated therewith.

Still another object of the present invention is to provide a new protective body garment for protecting the body from injury during sporting events.

Yet another object of the present invention is to provide a new protective body garment which includes a body covering. The body covering includes a torso portion and two sleeve portions fixedly coupled thereto. The torso portion has a neck opening therein. A plurality of pads is each fixedly coupled to the body covering. Each of the pads is covered by a panel sewn to the garment. Each of the panels are made from cloth. The pads generally cover the garment. A plurality of cushions is each fixedly coupled to the garment. Each of the cushions is covered by a panel, which is sewn to the garment. Each of the cushions has a base portion and a collapsible member. The collapsible member is fixedly coupled the base portion. The collapsible member is generally hollow. The collapsible member is directed away from the garment. A first cushion is fixedly coupled to a right elbow portion of the garment. A second cushion is fixedly coupled to a left elbow portion of the garment.

Still yet another object of the present invention is to provide a new protective body garment that has a plurality of pads and cushions which move independently of each other to offer free movement of the user.

Even still another object of the present invention is to provide a new protective body garment that contains collapsible cushions for joint areas to offer added protection.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
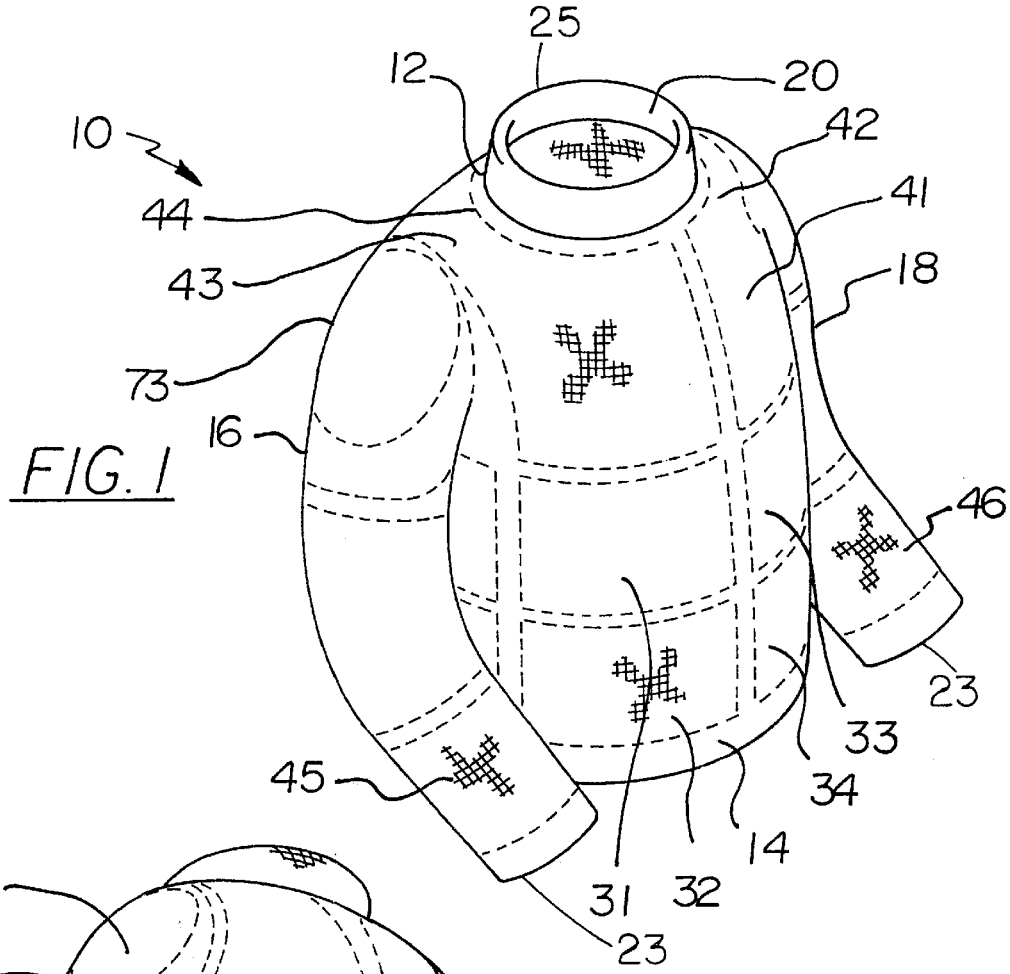
FIG. 1 is a schematic perspective view of a new protective body garment according to the present invention.
Figure 2:
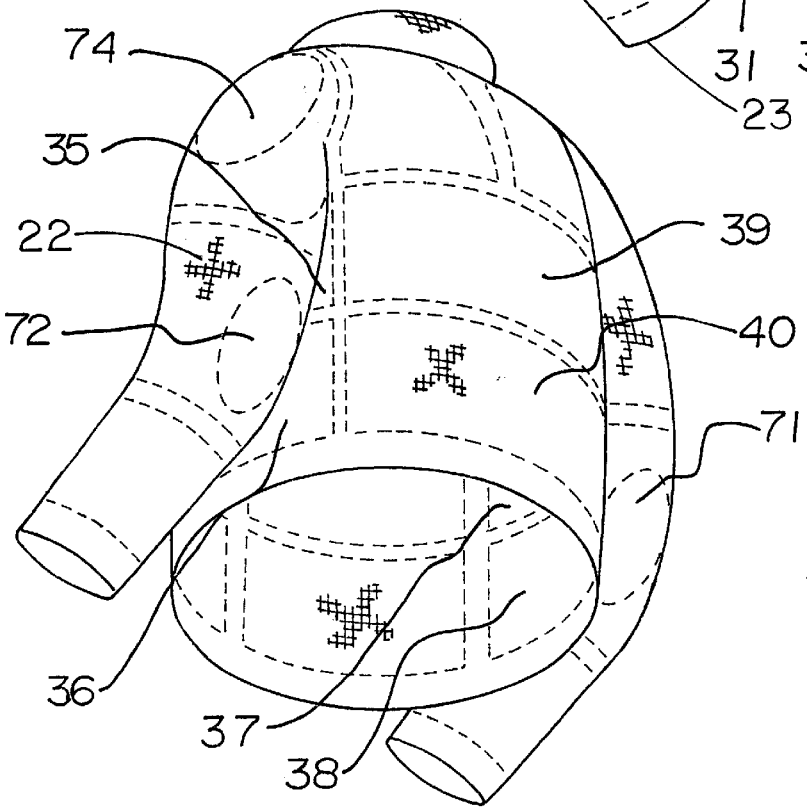
FIG. 2 is a schematic perspective view of the present invention.
Figure 3:
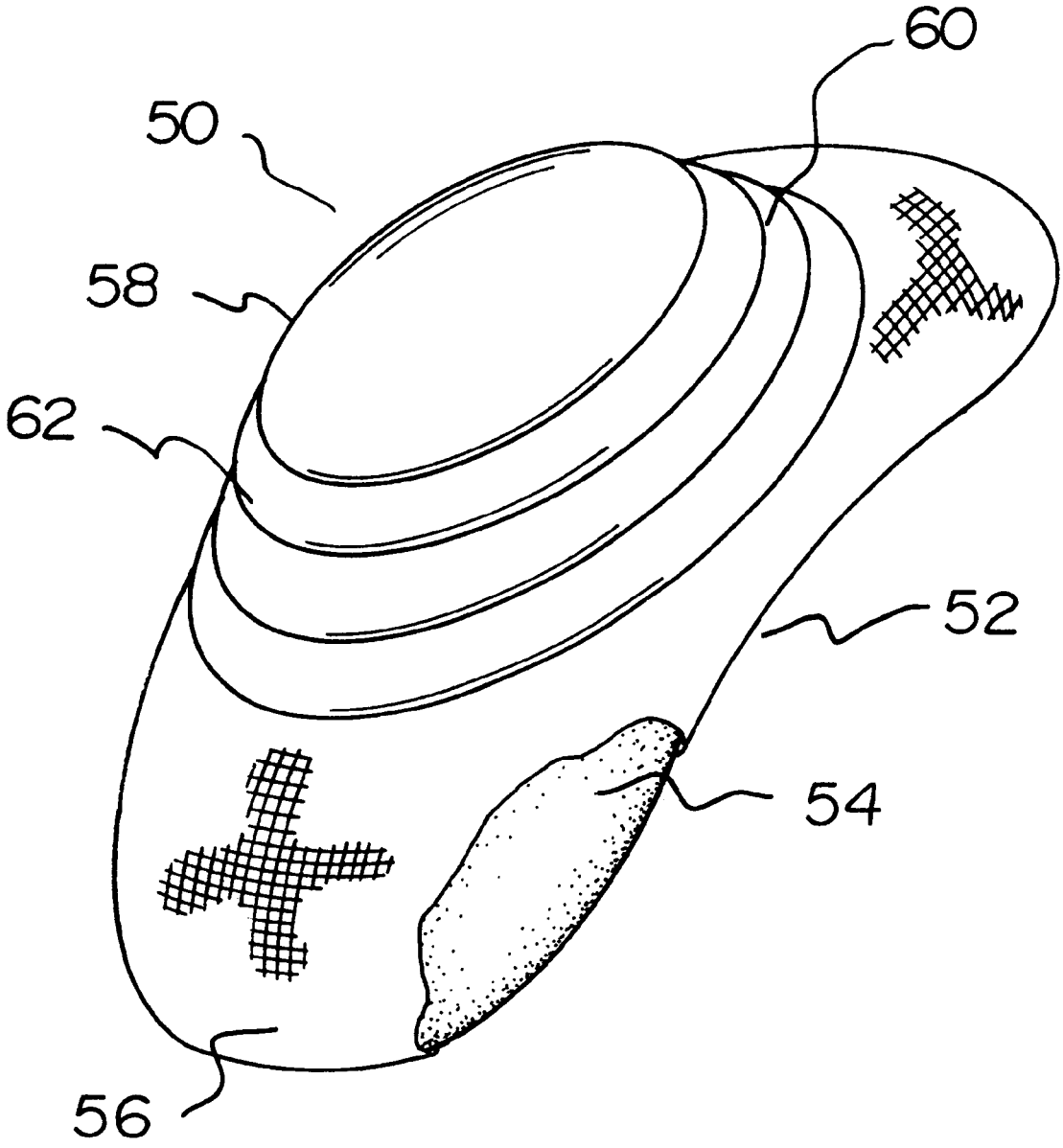
FIG. 3 is a schematic perspective view of a cushion of the present invention.

With reference now to the drawings, and in particular to FIGS. 1 through 3 thereof, a new protective body garment embodying the principles and concepts of the present invention and generally designated by the reference numeral 10 will be described.

As best illustrated in FIGS. 1 through 3, the protective body garment 10 generally comprises a body covering 12. The body covering 12 comprises a torso portion 14 and two sleeve portions 16, 18 fixedly coupled thereto. The torso portion 14 has a neck opening 20 therein. Ideally, the body covering 12 is comprised of a spandex material. Additionally, it would be beneficial if a neck band 25 and wrist bands 23 were attached to the neck opening and openings of the sleeve portions. The bands would preferably be conventional sweatbands comprised of a heavy cotton material for absorbing sweat.

A plurality of pads is each fixedly coupled to the body covering 12. Each of the pads is covered by a panel 22. The panels 22 are sewn to the body covering 12. Each of the panels 22 comprises a cloth. The plurality of pads include a first through fourteenth pads.

The first 31, second 32, third 33 and fourth 34 pads are positioned in a two by two matrix formation on a stomach portion of the body covering 12. The first through fourth pads each have a generally rectangular shape.

The fifth 35 and sixth 36 pads are positioned in a two by one matrix formation on a left side of the body covering 12. The fifth and sixth pads each have a generally rectangular shape.

The seventh 37 and eighth 38 pads are positioned in a two by one matrix formation on a right side of the body covering 12. The seventh and eight pads each have a generally rectangular shape.

The ninth 39 and tenth 40 pads are positioned in a two by one matrix formation on a back side of the body covering 12. The ninth and tenth pads each have a length which is long enough to transverse the back side of the body covering.

The eleventh pad 41 extends over a left shoulder portion of the body covering 12. The eleventh pad 41 is elongate and has a first end, a second end and a middle portion. The first end is generally located generally adjacent to one of the pads on the stomach portion of the body covering 12. The second end is generally located adjacent to one of the pads on the back portion. The middle portion has an annular groove therein 42. The annular groove 42 is directed toward the neck opening 20.

A twelfth pad 43 extends over a right shoulder portion of the body covering 12. The twelfth pad 43 is elongate and has a first end, a second end and a middle portion. The first end of the twelfth pad is generally located generally adjacent to one of the pads on the stomach portion of the body covering. The second end of the twelfth pad is generally located adjacent to one of the pads on the back portion. The middle portion of the twelfth pad has an annular groove 44 therein. The annular groove 44 in the twelfth pad is directed toward the neck opening 20.

A thirteenth pad 45 extends about a right forearm portion of the body covering 12, and a fourteenth pad 46 extends about a left forearm portion of the body covering.

Each of the first through fourteenth pads preferably comprises a compressed foamed elastomeric material.

A plurality of cushions 50 are each fixedly coupled to the body covering. Each of the cushions 50 is covered by a panel 22. Each of the panels is sewn to the body covering. The cushions 50 each have a base portion 52 and a collapsible member 58.

The base portion 52 has a generally a convex side 54 and a concave side, not shown but opposed to the convex side. The base portion 52 comprises a foamed elastomeric material. The base portion 52 is encased in a cloth covering 56, and the cloth covering is preferably a cotton cloth.

The collapsible member 58 is fixedly coupled to a generally central portion of the convex side 54 of the base portion 52. The collapsible member 58 is generally hollow and has a generally frusto-conical shape. A peripheral wall 60 of the collapsible member has a plurality of annular ridges 62 therein. The plurality of annular ridges are ideally three annular ridges. The collapsible member is preferably resiliently flexible. The collapsible member 58 is directed away from the body covering when the cushion 50 is coupled to the body covering 12.

A first cushion 71 is fixedly coupled to a right elbow portion of the body covering 12. A longitudinal axis of the base portion 52 is orientated generally parallel to a longitudinal axis of a right sleeve of the body covering 12.

A second cushion 72 is fixedly coupled to a left elbow portion of the body covering 12. A longitudinal axis of the base portion 52 is orientated generally parallel to a longitudinal axis of a left sleeve of the body covering.

A third cushion 73 is fixedly coupled to a right shoulder portion of the body covering 12. A longitudinal axis of the base portion 52 of the third cushion generally bisects the neck opening 20.

A fourth cushion 74 is fixedly coupled to a left shoulder portion of the body covering 12. A longitudinal axis of the base portion 52 of the fourth cushion generally bisects the neck opening 20.

In use, the user simply wears the garment like any other jersey. The spandex keeps the garment tight against the body of the user. The pads and cushions help protect the body of the user from injury while allowing movement because the pads and cushions are not coupled together.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective body garment, said garment comprising:

a body covering, said body covering comprising a torso portion and two sleeve portions fixedly coupled thereto, said torso portion having a neck opening therein;

a plurality of pads, each of said pads being fixedly coupled to said body covering, each of said pads being covered by a respective panel, each of said panels covering each of said pads being sewn to said garment, each of said panels comprising a cloth, said pads generally covering said garment;

a plurality of cushions, each of said cushions being fixedly coupled to said garment, each of said cushions being covered by a respective panel, each of said panels covering each of said cushions being sewn to said garment, each of said cushions comprising:

a base portion;

a collapsible member, said collapsible member being fixedly coupled to said base portion, said collapsible member being generally hollow, wherein said collapsible member is directed away from said garment;

a first cushion being fixedly coupled to a right elbow portion of said garment; and a second cushion being fixedly coupled to a left elbow portion of said garment;

wherein said plurality of cushions comprises:

said base portion having a generally concave side and a convex side, said base portion comprising a foamed elastomeric material, said base portion being encased in a cloth covering; and said collapsible member being fixedly coupled to a generally central portion of said convex side of said base portion.

2. The protective body garment as in claim 1, wherein said plurality of pads comprises:

first, second, third and fourth pads being positioned in a two by two matrix formation on a stomach portion of said body covering, said first through fourth pads each having a generally rectangular shape.

3. The protective body garment as in claim 2, wherein said plurality of pads comprises:

fifth and sixth pads being positioned in a two by one matrix formation on a left side of said body covering, said fifth and sixth pads each having a generally rectangular shape; and seventh and eighth pads being positioned in a two by one matrix formation on a right side of said body covering, said seventh and eight pads each having a generally rectangular shape.

4. The protective body garment as in claim 3, wherein said plurality of pads comprises:

ninth and tenth pads being positioned in a two by one matrix formation on a back side of said body covering, said ninth and tenth pads each having a length to transverse said back side of said body covering.

5. The protective body garment as in claim 1, wherein said collapsible member comprises:

said collapsible member having a generally frusto-conical shape, a peripheral wall of said collapsible member having a plurality of annular ridges therein, said plurality of annular ridges being three annular ridges, said collapsible member being resiliently flexible.

6. The protective body garment as in claim 5, wherein said cushions comprises:

a longitudinal axis of said base portion being orientated generally parallel to a longitudinal axis of a right sleeve of said body covering; and a longitudinal axis of said base portion being orientated generally parallel to a longitudinal axis of a left sleeve of said body covering.

7. The protective body garment as in claim 6, wherein said plurality of cushions further comprises:

a third cushion being fixedly coupled to a right shoulder portion of said body covering, a longitudinal axis of said base portion of said third cushion generally bisecting said neck opening; and a fourth cushion being fixedly coupled to a left shoulder portion of said body covering, a longitudinal axis of said base portion of said fourth cushion generally bisecting said neck opening.

8. A protective body garment, said garment comprising:

a body covering, said body covering comprising a torso portion and two sleeve portions fixedly coupled thereto, said torso portion having a neck opening therein;

a plurality of pads, each of said pads being fixedly coupled to said body covering, each of said pads being covered by a respective panel, each of said panels covering each of said pads being sewn to said garment, each of said panels comprising a cloth, said pads generally covering said garment;

a plurality of cushions, each of said cushions being fixedly coupled to said garment, each of said cushions being covered by a respective panel, each of said panels covering each of said cushions being sewn to said garment, each of said cushions comprising:

a base portion;

a collapsible member, said collapsible member being fixedly coupled to said base portion, said collapsible member being generally hollow, wherein said collapsible member is directed away from said garment;

a first cushion being fixedly coupled to a right elbow portion of said garment;

a second cushion being fixedly coupled to a left elbow portion of said garment; and wherein said plurality of pads comprises:

first, second, third and fourth pads being positioned in a two by two matrix formation on a stomach portion of said body covering, said first through fourth pads each having a generally rectangular shape;

fifth and sixth pads being positioned in a two by one matrix formation on a left side of said body covering, said fifth and sixth pads each having a generally rectangular shape;

seventh and eighth pads being positioned in a two by one matrix formation on a right side of said body covering, said seventh and eight pads each having a generally rectangular shape;

ninth and tenth pads being positioned in a two by one matrix formation on a back side of said body covering, said ninth and tenth pads each having a length to transverse said back side of said body covering;

an eleventh pad, said eleventh pad extending over a left shoulder portion of said body covering, said eleventh pad being elongate having a first end, a second end and a middle portion, said first end being generally located generally adjacent to one of said pads on said stomach portion of said body covering, said second end being generally located adjacent to one of said pads on said back portion, said middle portion having an annular groove therein, said annular groove being directed toward said neck opening; and a twelfth pad, said twelfth pad extending over a right shoulder portion of said body covering, said twelfth pad being elongate having a first end, a second end and a middle portion, said first end of said twelfth pad being generally located generally adjacent to one of said pads on said stomach portion of said body covering, said second end of said twelfth pad being generally located adjacent to one of said pads on said back portion, said middle portion of said twelfth pad having an annular groove therein, said annular groove in said twelfth pad being directed toward said neck opening.

9. The protective body garment as in claim 8, wherein said plurality of pads further comprises:

a thirteenth pad, said thirteen pad extending about a right forearm portion of said body covering; and a fourteenth pad, said fourteenth pad extending about a left forearm portion of said body covering.

10. A protective body garment, said garment comprising:

a body covering, said body covering comprising a torso portion and two sleeve portions fixedly coupled thereto, said torso portion having a neck opening therein, said body covering comprising a spandex material;

a plurality of pads, each of said pads being fixedly coupled to said body covering, each of said pads being covered by a respective panel, each of said panels covering each of said pads being sewn to said body covering, each of said panels comprising a cloth, said plurality of pads comprising:

first, second, third and fourth pads being positioned in a two by two matrix formation on a stomach portion of said body covering, said first through fourth pads each having a generally rectangular shape;

fifth and sixth pads being positioned in a two by one matrix formation on a left side of said body covering, said fifth and sixth pads each having a generally rectangular shape;

seventh and eighth pads being positioned in a two by one matrix formation on a right side of said body covering, said seventh and eight pads each having a generally rectangular shape;

ninth and tenth pads being positioned in a two by one matrix formation on a back side of said body covering, said ninth and tenth pads each having a length to transverse said back side of said body covering;

an eleventh pad, said eleventh pad extending over a left shoulder portion of said body covering, said eleventh pad being elongate having a first end, a second end and a middle portion, said first end being generally located generally adjacent to one of said pads on said stomach portion of said body covering, said second end being generally located adjacent to one of said pads on said back portion, said middle portion having an annular groove therein, said annular groove being directed toward said neck opening;

a twelfth pad, said twelfth pad extending over a right shoulder portion of said body covering, said twelfth pad being elongate having a first end, a second end and a middle portion, said first end of said twelfth pad being generally located generally adjacent to one of said pads on said stomach portion of said body covering, said second end of said twelfth pad being generally located adjacent to one of said pads on said back portion, said middle portion of said twelfth pad having an annular groove therein, said annular groove in said twelfth pad being directed toward said neck opening;

a thirteenth pad, said thirteen pad extending about a right forearm portion of said body covering;

a fourteenth pad, said fourteenth pad extending about a left forearm portion of said body covering;

each of said first through fourteenth pads comprising a compressed foamed elastomeric material;

a plurality of cushions, each of said cushions being fixedly coupled to said body covering, each of said cushions being covered by a respective panel, each of said panels covering each of said cushions being sewn to said body covering, each of said cushions comprising:

a base portion, said base portion having a generally concave side and a convex side, said base portion comprising a foamed elastomeric material, said base portion being encased in a cloth covering, said cloth covering comprising a cotton cloth;

a collapsible member, said collapsible member being fixedly coupled to a generally central portion of said convex side of said base portion, said collapsible member being generally hollow, said collapsible member having a generally frusto-conical shape, a peripheral wall of said collapsible member having a plurality of annular ridges therein, said plurality of annular ridges being three annular ridges, said collapsible member being resiliently flexible;

wherein said collapsible member is directed away from said body covering when said cushion is coupled to said body covering;

a first cushion being fixedly coupled to a right elbow portion of said body covering, a longitudinal axis of said base portion being orientated generally parallel to a longitudinal axis of a right sleeve of said body covering;

a second cushion being fixedly coupled to a left elbow portion of said body covering, a longitudinal axis of said base portion being orientated generally parallel to a longitudinal axis of a left sleeve of said body covering;

a third cushion being fixedly coupled to a right shoulder portion of said body covering, a longitudinal axis of said base portion of said third cushion generally bisecting said neck opening; and a fourth cushion being fixedly coupled to a left shoulder portion of said body covering, a longitudinal axis of said base portion of said fourth cushion generally bisecting said neck opening.

* * * * *